US005560837A

United States Patent [19]

Trueba

[11] Patent Number: 5,560,837

[45] Date of Patent: Oct. 1, 1996

[54] METHOD OF MAKING INK-JET COMPONENT

[75] Inventor: Kenneth E. Trueba, Corvallis, Oreg.

[73] Assignee: Hewlett-Packard Company, Palo Alto, Calif.

[21] Appl. No.: 336,405

[22] Filed: Nov. 8, 1994

[51] Int. Cl.[6] ..... B41J 2/16

[52] U.S. Cl. ..... 216/27; 430/394; 430/326; 430/312; 205/75; 205/127; 205/135; 29/890.1

[58] Field of Search ..... 430/326, 394, 430/312; 29/890.1; 216/27; 205/135, 75, 127

[56] References Cited

U.S. PATENT DOCUMENTS

| | | | |
|---|---|---|---|
| 3,561,964 | 2/1971 | Slaten | 430/312 |
| 4,142,893 | 3/1979 | Alderstein et al. | 430/312 |
| 4,229,265 | 10/1980 | Kenworthy | 204/11 |
| 4,250,242 | 2/1981 | Doering | 430/394 |
| 4,264,714 | 4/1981 | Trausch | 430/394 |
| 4,288,282 | 9/1981 | Brown | 430/394 |
| 4,773,971 | 9/1988 | Lam et al. | 204/11 |
| 4,839,001 | 6/1989 | Bakewell | 204/11 |
| 4,954,225 | 9/1990 | Bakewell | 204/11 |

*Primary Examiner*—George Fourson
*Assistant Examiner*—Scott Kirkpatrick

[57] ABSTRACT

A process for fabricating a thin-film structure using a transparent substrate is disclosed. A first structure, such as a ring having a central pillar, is formed of a conductive material on a surface of the substrate. A photoresist material pillar is formed on top of the conductive material central pillar by exposure through the transparent material. Such structures are useful as mandrel structures in the forming of precision thin-film components such as nozzle plates, mesh filter screens, and the like, for ink-jet pens.

18 Claims, 4 Drawing Sheets

METHOD OF MAKING INK-JET COMPONENT

CROSS REFERENCE TO RELATED PATENTS AND APPLICATIONS

This application is related to the subject matter disclosed in the following U.S. Patents and U.S. Patent Applications, all of which are assigned to the assignee of the present invention:

U.S. patent application Ser. No. 08/336,355, now U.S. Pat. No. 5,443,713 filed on the same date as the present application by Gregory T. Hindman for a THIN-FILM STRUCTURE METHOD OF FABRICATION, incorporated herein by reference in its entirety.

BACKGROUND OF THE INVENTION

The present invention generally relates to thin-film manufacturing techniques and, more specifically, to a self-aligning fabrication process used to produce thin-film mandrel structures useful for electroforming ink-jet pen components.

As is well-known to persons skilled in the art, many publications describe the details of common techniques used in thin-film fabrication processes. Reference to general texts, such as *Silicon Processing for the VLSI Era* by Stanley Wolf and Richard Tauber, copyright 1986, Lattice Press publishers, and *VLSI Technology*, S. M. Sze editor, copyright 1986, McGraw-Hill publishers (each incorporated herein by reference in applicable parts), is recommended, as those techniques can be generally used in the present invention. Moreover, the individual steps of such processes can be performed using commercially available integrated circuit fabrication machines.

The art of ink-jet technology is also relatively well developed. Commercial products such as computer printers, graphics plotters, and facsimile machines employ ink-jet technology to produce hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions, incorporated herein by reference. The state of the art is continually developing to improve the quality of the fundamental dot matrix form of printing intrinsic to ink-jet technology. Current products have achieved print densities of up to 1200 dots-per-inch ("DPI"), achieving print quality comparable to the more expensive laser printers. To that end, thin-film technology has been employed to produce precision components such as orifice plates, fine mesh ink filters, and the like, for ink-jet pens.

For example, ink-jet pens can utilize an orifice plate generally formed on a thin-film mandrel. The mandrel can consist of a glass plate coated with a conductive film. Non-conductive discs are defined on the surface of the conductive film for determining the location and size of the orifices. Generally, the discs are about three times the diameter of the target hole size. The orifice size is determined by carefully controlling the electroplating parameters (current, timing, and the like) for forming an orifice plate on the mandrel. Therefore, a variation in these parameters will directly affect the size of the orifices. Moreover, if a thicker orifice plate is needed, it is necessary to increase the disc size. Manufacturing tolerances limit such disc dimensioning, resulting in a decreased orifice diameter if the thickness of the orifice plate increases over the disc size tolerance.

A standard manufacturing process for producing mandrel structures used for electroforming ink-jet components is shown in FIG. 1 (Prior Art). The process begins with a commercially available dielectric substrate 102, such as a silicon dioxide wafer or a transparent glass (FIG. 1A). As is known in the art, such wafers have a highly polished, flat surface 104. To insure proper adhesion, the surface 104 is cleaned and then a thin-film of metal 106, such as stainless steel, is deposited across the surface 104, forming a new surface 108 (FIG. 1B). A dielectric film 110 is deposited on the surface 108 of the metal layer 106 (FIG. 1C). Next, the dielectric layer 110 is covered with a photoresist 112 (FIG. 1D). The photoresist 112 is masked and developed to a desired pattern (FIG. 1E). The dielectric layer 110 is then etched (FIG. 1F). The patterned structure, for example, disk constructs 116, can now serve as a mandrel structure for forming a workpiece (FIG. 1G). As shown in FIG. 1H, a metal workpiece 118 is electroformed on the surface 108 of the metal layer 106. During electroforming, metal is initially deposited onto the conductive areas of the structure; that is, onto the metal layer surface 108, but not onto dielectric disk constructs 116. However, as the deposited metal thickness increases, the metal flows and partially plates over the disk constructs 116. When the workpiece 118 reaches the predetermined proper thickness or proper dimensions, the plating is stopped and the electroformed workpiece 118 is removed from the mandrel structure (FIG. 1I). In actual practice, a plurality of workpieces are formed on each substrate.

Examples of other processes are disclosed in U.S. Pat. Nos. 4,773,971 (Lam et al.)(assigned to the common assignee of the present invention), 4,954,225 and 4,839,001 (Bakewell) and 4,229,265 (Kenworthy).

There are several drawbacks to using the mandrel structure formed by these conventional prior art processes. Any defects in the dielectric layer, such as a stray particle, a pinhole, or any edge roughness in the pattern, will replicate as a defect in the electroformed workpiece 118. In fact, the electroforming process will inherently magnify any defect of the mandrel in the workpiece 118.

Generally, such methods of forming mandrels of a dielectric require critical alignment for the exposure process steps. A misaligned mandrel will result in an asymmetrical and offset orifice when the construct is used as a mandrel. If a second exposure process for forming the mandrels is used in a particular fabrication, the alignment between the two features so formed is absolutely critical. Thus, variations of such processes may call for more than one such critical alignment. Even small errors can negatively impact the electroforming process yield since many components are formed on one wafer.

Another problem is that if the mandrel size is fixed or otherwise constrained in size by the need to achieve a certain packing density, the electroform thickness and the dimensions of the electroformed part can not be controlled independently. The final shape of the workpiece is controlled by the physics of the electroforming steps of the process.

Therefore, there is a need for an improved thin-film process to form thin-film structures such as a mandrel structure or pattern of mandrels.

SUMMARY OF THE INVENTION

In its basic aspects, the present invention provides a process for fabricating a thin-film structure. A process for fabricating a thin-film structure in accordance with the present invention includes the steps of: forming a first predetermined construct of a conductive material on a first surface of a transparent substrate; defining a second predetermined construct of a photoresist material on said first predetermined construct by exposing a layer of photoresist material through said transparent substrate wherein said first predetermined construct functions as a mask during said exposing; masking at least a portion of said second predetermined construct for direct exposure from above said first surface; exposing said photoresist material by direct exposure from above said first surface; and forming said second construct by developing said photoresist material.

It is an advantage of the present invention that it allows fabrication of a thin-film structure to closer manufacturing tolerances.

It is another advantage of the present invention that it provides a method of manufacturing ink-jet printheads having orifice plates of a greater thickness while maintaining and improving manufacturing tolerances of the orifices.

It is another advantage of the present invention that the location of thin-film structures are self-aligning by use of predetermined patterns formed during the process.

It is yet another advantage of the present invention that it is tolerant of defects in a surface or in an edge of a dielectric thin-film mandrel structure.

It is an advantage of the present invention that the final shape of a workpiece can be controlled by the predetermined shaping of mandrel pillars formed in accordance with the disclosed process.

It is yet another advantage of the present invention that the shape of thin-film mandrel pillars can be controlled by predetermined shaping of dielectric thin-film elements.

It is an advantage of the present invention that it provides a mandrel structure which is reusable.

Other objects, features and advantages of the present invention will become apparent upon consideration of the following detailed description and the accompanying drawings, in which like reference designations represent like features throughout the FIGURES.

DESCRIPTION OF THE DRAWINGS

(FIGS. 4A and 4C through 4F are cross-sectional, partial views; FIG. 4B is a partial top view) of a process for forming a base structure for an alterative, reusable thin-film mandrel structure of the present invention as shown in FIG. 2.

The drawings referred to in this description should be understood as not being drawn to scale except if specifically noted.

DETAILED DESCRIPTION OF THE INVENTION

Reference is made now in detail to a specific embodiment of the present invention which illustrates the best mode presently contemplated by the inventor for practicing the invention. Alterative embodiments are also briefly described as applicable. The process steps described herein are performed with commercial thin-film fabrication apparatus and tools. Therefore, certain specifications will be dependent on the make and model of the equipment employed and the design of the thin-film structure to be achieved. As specifically necessary to an understanding of the present invention, exemplary technical data are set forth based upon current technology. Future developments in this art and design expedients may call for appropriate adjustments as would be obvious to one skilled in the art.

Figure 1A:
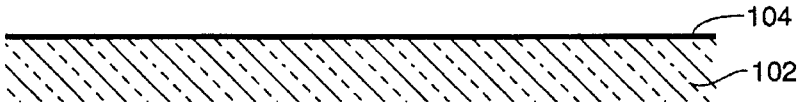
FIG. 1A (PRIOR ART)
FIGS. 1A through 1I, are a schematic depiction (partial and cross-sectional) of a process for forming a thin-film mandrel structure and a workpiece.
Figure 1B:
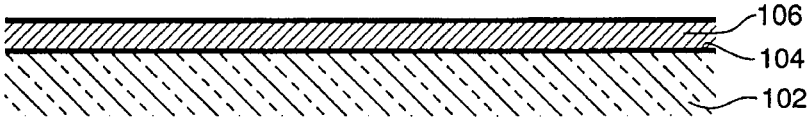
FIG. 1B (PRIOR ART)
Figure 1C:
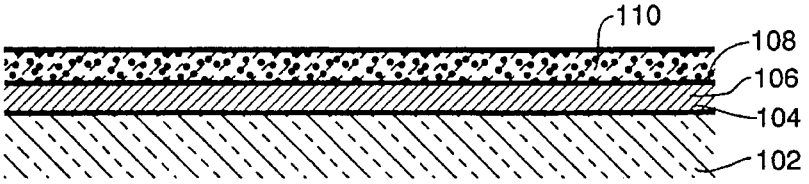
FIG. 1C (PRIOR ART)
Figure 1D:
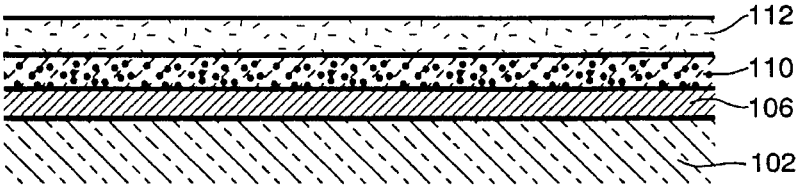
FIG. 1D (PRIOR ART)
Figure 1E:
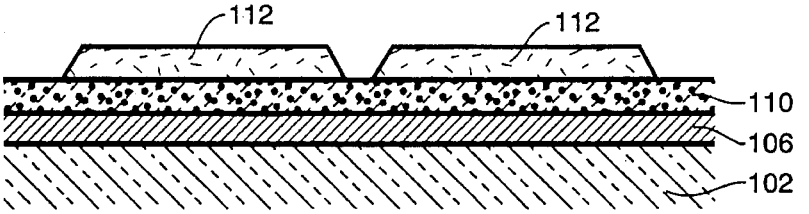
FIG. 1E (PRIOR ART)
Figure 1F:
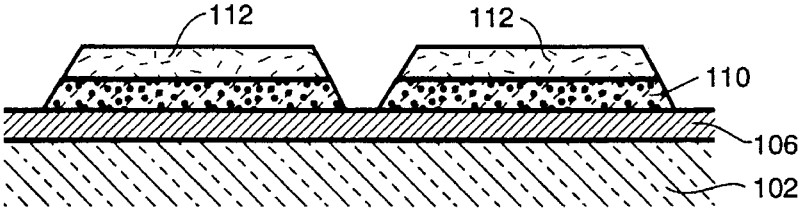
FIG. 1F (PRIOR ART)
Figure 1G:
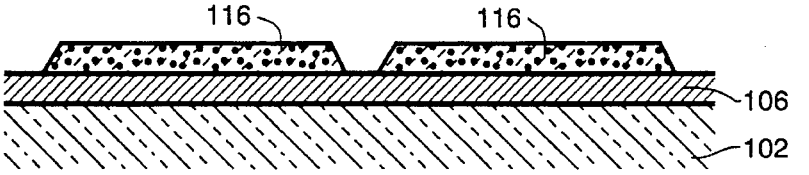
FIG. 1G (PRIOR ART)
Figure 1H:
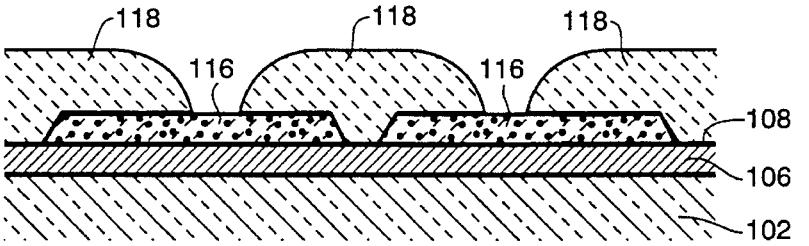
FIG. 1H (PRIOR ART)
Figure 1I:
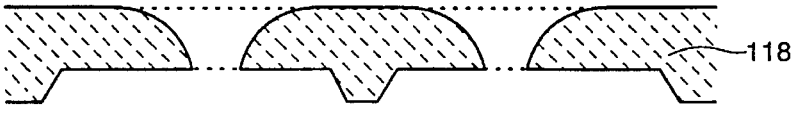
FIG. 1I (PRIOR ART)
Figure 2A:
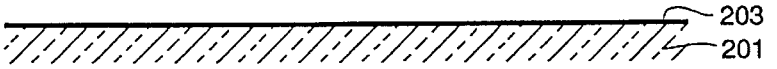
FIGS. 2A through 2L, are a schematic depiction (partial and cross-sectional) of a process for forming a thin-film mandrel structure and a workpiece in accordance with the present invention.
Figure 2B:
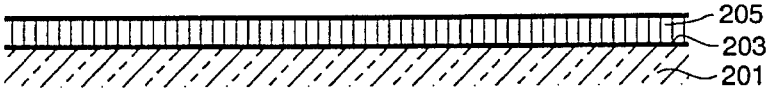
Figure 2C:
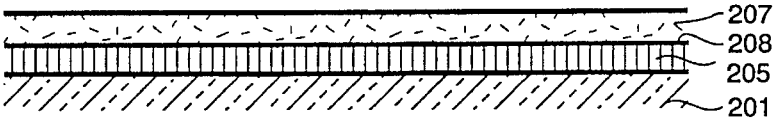
Figure 2D:
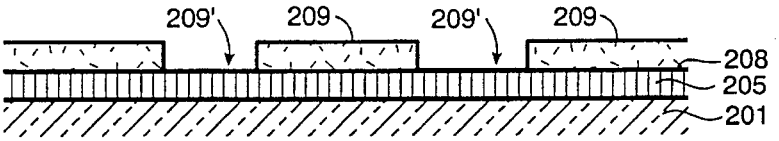
Figure 2E:
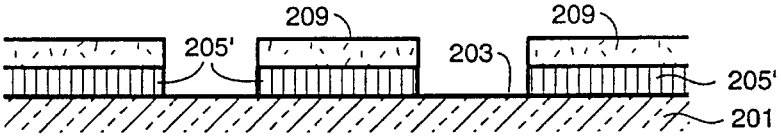
Figure 2F:
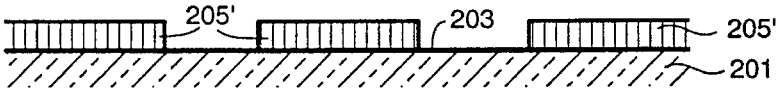
Figure 2G:
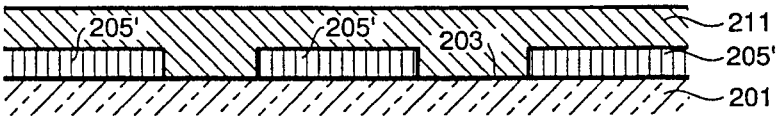
Figure 2H:
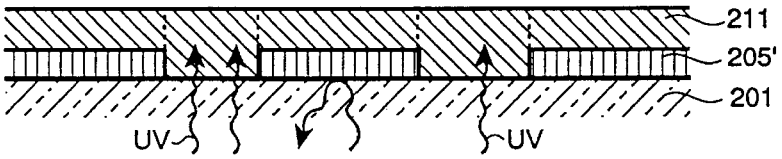
Figure 2I:
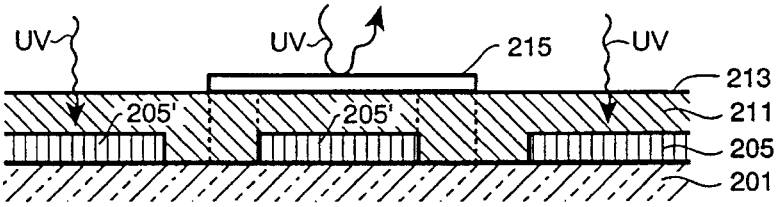
Figure 2J:
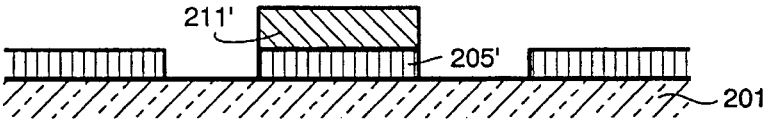
Figure 2K:
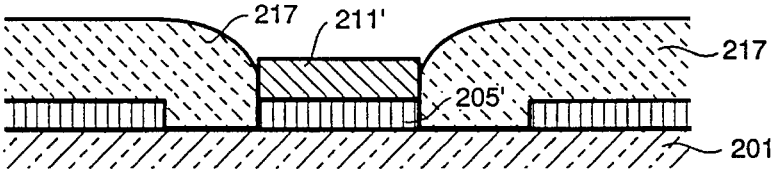
Figure 2L:
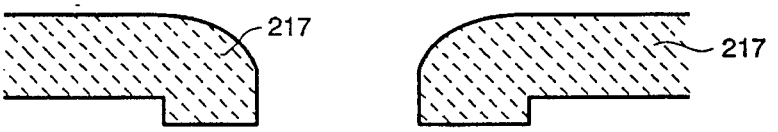
Figure 3:
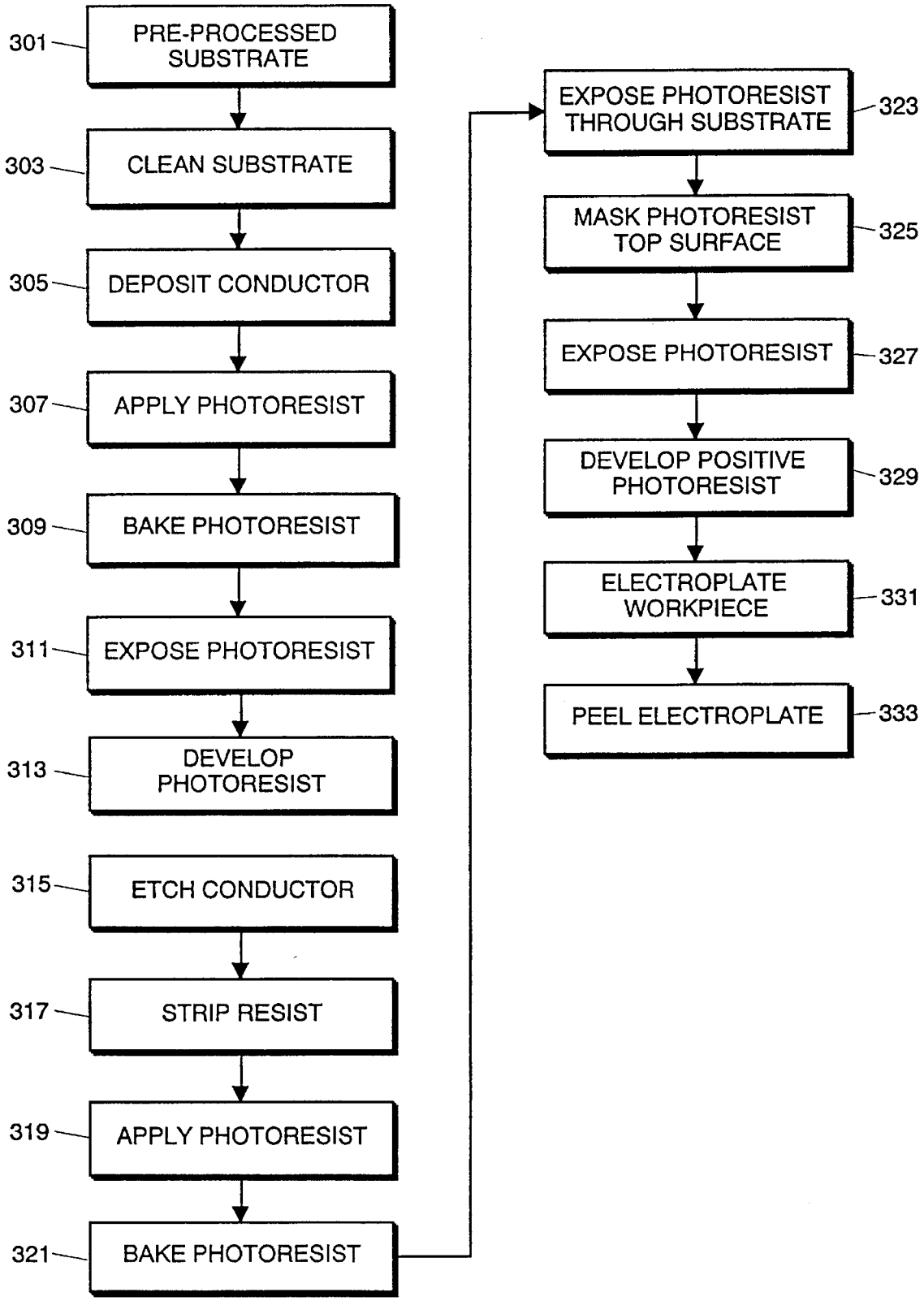
FIG. 3 is a flow chart of the process steps in accordance with the present invention as shown in FIG. 2.

Referring to FIGS. 2 and 3, the process begins 301 with a commercially available transparent glass substrate 201 having a polished surface 203 as depicted in FIG. 2A. (For the purpose of the disclosure of this preferred embodiment, "transparent" means for wavelengths required to expose a photoresist #3, typically wavelengths longer than 350 nanometers; however, this factor will be process dependent with design variations based upon the materials employed for a particular adaptation.)

Generally, as is known in the art, the process is performed in a clean room environment.

The substrate 201 is cleaned 303. Cleaning is dependent upon the quality of the commercial substrate used. For example, for a thorough cleaning, a solution such as a sulfuric acid-hydrogen peroxide mixture is followed by a mixture of isopropyl alcohol, ammonium hydroxide, and de-ionized water. The cleaning period should be sufficient, e.g., ten minutes in each bath, to insure all imperfections, dust, and the like, have been removed from the substrate surface 203. Other solutions for cleaning the substrate and other techniques generally known in the art (such as ultrasonic scrubbing) can be employed.

As shown in FIG. 2B, a conductive layer 205 is then deposited 305 on the cleaned substrate surface 203. In the preferred embodiment, a sputtering process is used to deposit a layer of opaque, conductive material, such as chrome metal, having a thickness in the range of 800 to 1000 Angstroms.

Referring now to FIG. 2C, a layer of photoresist 207 (such as AZ 1518 by Hoechst company), approximately two microns thick, is applied 307 onto a surface 208 of the conductive layer 205. After baking 309, the photoresist layer 207 is photographically exposed 311 and developed 313 in place to provide a resist pattern in accordance with a predetermined structure on the surface 208 of the conductive layer 205 as depicted in FIG. 2D.

By using a predetermined masking pattern, the constructs can be formed into a plurality separate constructs, such as annular rings, each surrounding a central pillar. As will be shown hereinafter, the same central pillar thus can also serve as a portion of a mandrel when the process is used to provide a predetermined structure for forming thin-film ink-jet components. Essentially, in such an application as for the purpose of forming a mandrel structure for the electroforming of ink-jet pen components (such as orifice plates or mesh ink filter screens), the photoresist pattern comprises a set of raised annular rings, "donut" shaped constructs, 209 having central "island" pillars 209'.

Now referring to FIG. 2E, with the photoresist pattern constructs 209, 209' in place, using an etch chemistry (for example, ferric-oxide), the conductive layer 205 is etched 315 from surface 203 of the substrate 201. This transforms the conductive layer under the developed photoresist constructs 209, 209' into conforming conductive material "donut" constructs 205'.

The remaining unexposed photoresist 209 is then stripped 317, leaving conductive material layer constructs 205' as shown in FIG. 2F. The conductive material constructs 205' will act as a mask in the next step of the process.

As depicted in FIG. 2G, in a similar manner as the previous masking steps, a second layer of photoresist 211 is applied 319 onto the surface 203 of the substrate 201, covering the conductive material constructs 205'. This photoresist layer 211 is a thick layer, on the order of one to two mils, formed of a positive photoresist, such as AZ4230 available from Shipley company. After baking 321, as shown in FIG. 2H, the photoresist 211 is exposed 323 to ultraviolet light (represented by arrows labeled "UV") through the transparent substrate 201, such that the conductive material layer constructs 205' appropriately mask predetermined regions.

In the next step, as shown in FIG. 21, a crudely aligned mask construct 215 is formed 325 on the surface 213 of photoresist layer 211. This mask is formed by a standard photolithography technique using chrome mask blanks. The purpose of the crude mask construct 215 is to protect the central pillar of the "donut" construct during the next phase of the process in which the photoresist layer 211 is then exposed 327 to ultraviolet radiation from the top (rather than through substrate 201).

The resist is thereafter developed 329, leaving a pillar construct 211' on the center conductive layer construct 205' of the donut as shown in FIG. 2J.

In this manner the pillar 211' so formed can define a mandrel 211' for electroforming 331 a workpiece having an orifice with the dimensions of the pillar 211'.

Formation of such a workpiece 217 is depicted in FIG. 2K. When the electroforming process is finished, the workpiece 217 is peeled 335 from the mandrel. As will be recognized by a person skilled in the art, the depiction of the process as shown in FIG. 2 is for one of a series of mandrels on the substrate.

In the exemplary embodiment of fabricating an ink-jet pen nozzle plate, the mandrel construct is plated with a nickel compound. The final shape of the electroformed workpiece 217, that is, the cross-sectional shape of the orifices of the nozzle plate, will be controlled by the shape of the mandrel pillars 211'. Moreover, the final dimensions of the electroformed workpiece 217, that is, the dimensions of the orifices of the nozzle plate, are also controlled independently of shape over a range established by the height of the pillars 211'.

Defects in the dielectric or in the edge of the dielectric pattern are no longer replicated in the workpiece 217.

A mandrel construct fabricated in accordance with the present invention can be made reusable and should exhibit longevity substantially exceeding that fabricated in accordance with the prior art by the addition of another set of base layers to the construct shown in FIG. 2J. A relatively permanent mandrel construct could be fabricated with a metal film provided the metal has relatively strong adhesion to the substrate frontside surface and is etched with smooth edges.

Figure 4A:
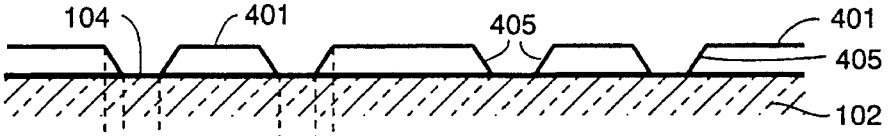
FIGS. 4A through 4F, are a schematic depiction
Figure 4B:
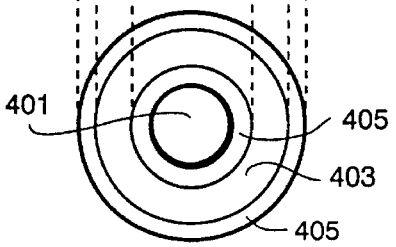

As shown in FIGS. 4A and 4B, in accordance with standard fabrication techniques such as discussed above, metal donut structures 401 are formed on a glass substrate 102 using any metal which exhibits a good adhesion to the substrate surface 104, where the clear substrate areas 403 form a "donut" shape. Edges of the donuts 401 are tapered 405 so that subsequent electroplating steps do not lift the donuts structures 401.

Figure 4C:
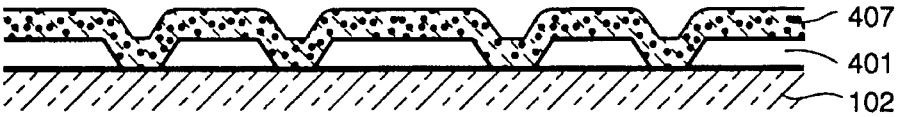

Starting with these defined metal donut structures 401 on the substrate 102, a layer of a dielectric material 407 applied, such as by a CVD process (FIG. 4C).

Figure 4D:
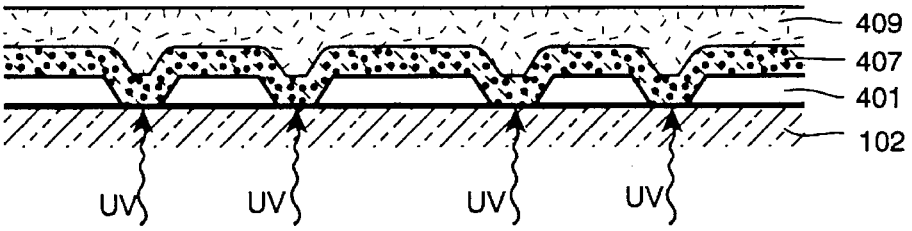
Figure 4E:
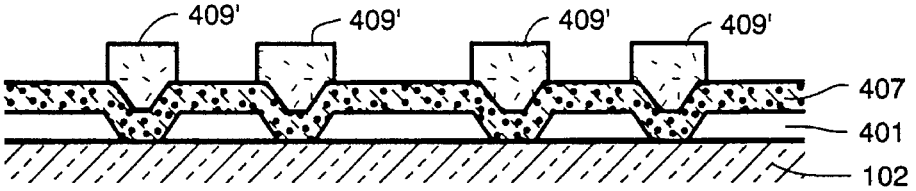

Next, a layer of negative photoresist 409 is applied, then exposed through the transparent substrate 102 ("backside" exposure; represented by arrows labelled "UV") (FIG. 4D). The donuts 401 act as a mask such that when the photoresist is then developed, pillars of photoresist 409' remain on the structure (FIG. 4E).

Figure 4F:
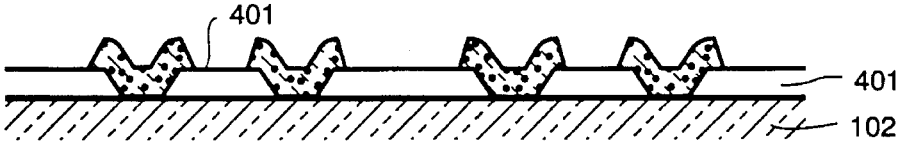

Both the remaining photoresist pillars 409' and the uncovered regions of dielectric material 407 are etched from the structure (FIG. 4F). What remains is a metal layer structure having the donuts' clear areas 403 "filled" with a dielectric. This protects the edges of the metal donuts during subsequent process steps.

From this structure, the process as shown in FIGS. 2G through 2L are performed, leaving the structure as shown in FIG. 4F as a reusable mandrel structure.

The interdependency and limitations on the electroform thickness and the dimensions of the workpiece 217 as prevalent in the prior art is eliminated. With such problems eliminated, a relatively large increase of the packing density can be achieved. That is, in the exemplary embodiment disclosed, the spacing of orifices in an ink-jet pen nozzle plate, can be greatly reduced and the bore diameter held to tighter tolerances. Similar advantages are realized in the formation of ink filter screens. This results in the ability to increase the DPI density on a print medium, thus increasing print quality.

While in the preferred embodiment described above, a metal layer has been used as a first construct of a thin-film mandrel, it will be recognized by those skilled in the art that in the alterative any material capable of acting as a photoresist mask for the step of exposing a photoresist through the substrate can be substituted.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A process for fabricating a thin-film structure, comprising:

forming a first construct of a conductive material on a portion of a first surface of a transparent substrate by forming a layer of a conductive material on said first surface of said transparent substrate, forming a layer of photoresist superposing said layer of a conductive material, exposing and developing said layer of photoresist to form at least one annular structure portion encompassing a central pillar portion, and etching said layer of conductive material using said annular structure portion and said central pillar portion as an etch process mask such that at least one first construct comprising an annular structure portion encompassing a central pillar portion remains on said first surface of said transparent substrate;

defining a second construct of a photoresist material on said first construct by exposing a layer of photoresist material through said transparent substrate wherein said first construct functions as a mask during said exposing;

masking at least a portion of said second construct for direct exposure from above said first surface;

exposing said photoresist material by direct exposure from above said first surface; and forming said second construct by developing said photoresist material thereby forming a pillar of said photoresist on said central pillar portion.

2. The process as set forth in claim 1, wherein said step of forming a second construct further comprises:

forming a plurality of said second constructs on said surface of said substrate to function as mandrels for fabricating ink-jet pen nozzle plates.

3. The process as set forth in claim 1, wherein said step of forming a second construct further comprises:

forming a plurality of said second constructs on said surface of said substrate to function as mandrels for fabricating ink-jet pen filter screens.

4. The process as set forth in claim 1, wherein said step of forming a first construct comprises:

forming a set of conductive material constructs on said transparent substrate; and further comprises filling spaces between said conductive material constructs with a dielectric material.

5. The process as set forth in claim 4, wherein said step of forming a set of conductive material constructs comprises:

depositing a metal layer to adhere to said transparent substrate;

processing said metal layer to form metal layer constructs.

6. The process as set forth in claim 5, wherein said step of filling spaces between said conductive material constructs with a dielectric material further comprises:

covering said metal layer with a dielectric material layer;

covering said dielectric layer with a negative photoresist;

exposing said photoresist through said transparent substrate;

developing said photoresist; and etching said dielectric layer, whereby dielectric material remains on said substrate only in said spaces between said metal layer constructs.

7. A method for fabricating a thin-film mandrel structure on a substrate having the property of transparency, comprising:

forming regions of a mandrel first portion and second portion of a conductive material on a first surface of said substrate;

depositing a layer of photoresist material superjacent said mandrel first portion and second portion and said first surface of said substrate not covered by said regions of said mandrel first portion and second portion;

exposing said photoresist material through said transparent substrate whereby said mandrel first portion and second portion masks superjacent regions of said photoresist material leaving unexposed regions of said photoresist material superjacent said mandrel first portion and second portion;

forming a mask on said unexposed region of said photoresist material superjacent said mandrel first portion;

exposing said photoresist material such that said mask shields said unexposed region of said photoresist material superjacent said mandrel first portion;

developing said photoresist material; and removing exposed photoresist material whereby a mandrel is formed of a layer of said unexposed region of said photoresist material superposing said mandrel first portion.

8. The method as set forth in claim 7, wherein said step of forming regions of a mandrel first portion and second portion of a conductive material on a first surface of said substrate comprises:

providing a glass substrate;

depositing a layer of metal on said first surface of said substrate;

forming a layer of photoresist on said layer of metal;

masking said layer of photoresist with a first pattern for forming a plurality of mandrels on said first surface of said substrate;

exposing unmasked regions of said photoresist;

developing said photoresist;

stripping said unmasked regions of said photoresist whereby masked regions of said photoresist remain on regions of said layer of metal as an etching mask;

etching unmasked regions of said metal layer down to said first surface of said substrate; and stripping said etching mask, whereby a plurality of mandrel first portions and second portions remain on said first surface of said substrate.

9. The method as set forth in claim 8, further comprising:

forming a plurality of said thin-film mandrel structures on said substrate having a shape, dimensions and spacing for forming an ink-jet pen nozzle plate thereon.

10. The method as set forth in claim 8, further comprising:

forming a plurality of said thin-film mandrel structures on said substrate having a shape, dimensions and spacing for forming an ink-jet pen ink filter screen thereon.

11. A method for fabricating an ink-jet pen component having a plurality of orifices of shape and dimensions at a spacing on said pen component, comprising:

providing a transparent substrate;

forming a plurality of opaque constructs on said substrate having a pattern conforming to said shape and dimensions at a spacing for said pen component;

forming a photoresist mandrel portion on said plurality of opaque constructs by:

overlaying said opaque constructs and said substrate with a photoresist material, exposing said photoresist through said substrate using said opaque constructs to mask portions of said photoresist overlaying said opaque constructs, masking said photoresist over a subset of said opaque constructs in accordance with said pattern conforming to said shape and dimensions at a spacing for said pen component, exposing said photoresist material such that all unmasked regions are exposed, developing said photoresist material, and stripping all exposed photoresist material whereby a photoresist construct overlays said subset of said opaque constructs;

forming said pen component using said opaque constructs and opaque constructs having said overlaying photoresist constructs as a mandrel structure to form said pen component.

12. The method as set forth in claim 1, wherein said step of forming said pen component further comprises:

electroforming a pen component onto said substrate and said opaque constructs such that said subset of opaque constructs having said overlaying photoresist constructs act as orifice mandrels; and peeling said pen component from said substrate and said constructs.

13. A method for fabricating a reusable thin-film mandrel structure, comprising:

forming a layer of conductive material constructs on said substrate frontside surface such that said constructs form annular ring-shaped regions of substrate frontside surface, each construct having a pillar of conductive material centrally located therein;

forming dielectric rings on said ring-shaped regions of substrate frontside surface;

forming pillars of a photoresist material on each said pillar of conductive material by forming a layer of photoresist material on said frontside, exposing said photoresist through said backside such that said conductive material constructs function as a mask during said exposing, masking said photoresist material over said pillars of conductive material, exposing said photoresist material, and developing said photoresist material.

14. The method as set forth in claim 3, wherein said step of forming a layer of conductive material constructs on said substrate frontside surface comprises:

depositing a metal layer having relatively strong adhesion with said substrate frontside surface; and processing said metal layer to form metal layer constructs.

15. The process as set forth in claim 4, wherein said step of forming dielectric rings on said ring-shaped regions of substrate frontside surface comprises:

covering said metal layer with a dielectric material layer;

covering said dielectric layer with a negative photoresist;

exposing said photoresist through said backside surface;

developing said photoresist; and etching said dielectric layer, whereby dielectric material remains on said substrate only in said spaces between said metal layer constructs.

16. The method as set forth in claim 3, wherein said step of forming pillars of a photoresist material on each said pillar of conductive material further comprises:

forming a plurality of said pillars of a photoresist material in a pattern to function as mandrels for electroforming ink-jet pen components thereon.

17. The method as set forth in claim 6, wherein said step of forming a plurality of said pillars of a photoresist material in a pattern further comprises:

forming said pillars of a photoresist material in a pattern to electroform an ink-jet orifice plate thereon.

18. The method as set forth in claim 6, wherein said step of forming a plurality of said pillars of a photoresist material in a pattern further comprises:

forming said pillars of a photoresist material in a pattern to electroform an ink-jet ink mesh filter screen thereon.

* * * * *